US010844335B2

(12) United States Patent
Lee et al.

(10) Patent No.: US 10,844,335 B2
(45) Date of Patent: Nov. 24, 2020

(54) COMPOSITION FOR PERFORMING CLEANING AFTER CHEMICAL/ MECHANICAL POLISHING

(71) Applicant: YOUNG CHANG CHEMICAL CO., LTD, Gyeongsangbuk-do (KR)

(72) Inventors: Seung Hun Lee, Daegu (KR); Seung Hyun Lee, Daegu (KR); Seong Hwan Kim, Daegu (KR)

(73) Assignee: YOUNG CHANG CHEMICAL CO., LTD, Gyeongsangbuk-do (KR)

( * ) Notice: Subject to any disclaimer, the term of this patent is extended or adjusted under 35 U.S.C. 154(b) by 0 days.

(21) Appl. No.: 16/489,179

(22) PCT Filed: Mar. 6, 2018

(86) PCT No.: PCT/KR2018/002644
§ 371 (c)(1),
(2) Date: Aug. 27, 2019

(87) PCT Pub. No.: WO2018/169240
PCT Pub. Date: Sep. 20, 2018

(65) Prior Publication Data

US 2019/0382698 A1 Dec. 19, 2019

(30) Foreign Application Priority Data

Mar. 17, 2017 (KR) ..... 10-2017-0033706

(51) Int. Cl.

| | |
|---|---|
| ***C11D 7/32*** | (2006.01) |
| ***C11D 11/00*** | (2006.01) |
| ***C11D 7/26*** | (2006.01) |
| ***C11D 7/50*** | (2006.01) |

(52) U.S. Cl.
CPC ..... *C11D 11/0047* (2013.01); *C11D 7/263* (2013.01); *C11D 7/3209* (2013.01); *C11D 7/3218* (2013.01); *C11D 7/3281* (2013.01); *C11D 7/50* (2013.01)

(58) Field of Classification Search
CPC ..... C11D 11/0047
USPC ..... 510/175
See application file for complete search history.

(56) References Cited

U.S. PATENT DOCUMENTS

| | | | | |
|---|---|---|---|---|
| 2010/0056415 | A1 | 3/2010 | Rong et al. | |
| 2015/0045277 | A1* | 2/2015 | Liu | C11D 7/3245 510/175 |

FOREIGN PATENT DOCUMENTS

| | | | |
|---|---|---|---|
| KR | 10-2003-0051721 | A | 6/2003 |
| KR | 10-2014-0139565 | A | 12/2014 |
| KR | 10-2015-0054471 | A | 5/2015 |
| KR | 10-2015-0085593 | A | 7/2015 |
| KR | 10-1572639 | B1 | 11/2015 |
| KR | 10-2015-0143676 | A | 12/2015 |
| KR | 10-2016-0083885 | A | 7/2016 |
| KR | 10-1789251 | B1 | 10/2017 |

* cited by examiner

*Primary Examiner* — Gregory E Webb
(74) *Attorney, Agent, or Firm* — Novick, Kim & Lee, PLLC; Jae Youn Kim

(57) ABSTRACT

Disclosed is a post-chemical-mechanical-polishing cleaning composition, which is capable of effectively removing impurities from the surface of a wafer substrate after chemical mechanical polishing and also of preventing the corrosion of metal line materials, and which includes choline hydroxide, tetrabutylammonium hydroxide, 1,2,4-triazole, 2-hydroxypyridine, and the remainder of ultrapure water.

3 Claims, No Drawings

COMPOSITION FOR PERFORMING CLEANING AFTER CHEMICAL/ MECHANICAL POLISHING

TECHNICAL FIELD

The present invention relates to a post-chemical-mechanical-polishing cleaning composition, and more particularly to a cleaning composition suitable for use in cleaning a semiconductor substrate including metal lines and metal films during the fabrication of semiconductors, especially cleaning a semiconductor substrate in which metal lines are exposed after chemical mechanical polishing.

A cleaning solution composition according to the present invention has a pH ranging from 9 to 13 and is thus capable of effectively removing residues and contaminants and suppressing copper corrosion, thereby enabling the fabrication of superior semiconductors.

BACKGROUND ART

As the line width of metal lines is gradually reduced in a semiconductor process, resistance is increased due to a decrease in the cross-sectional area of the metal lines, and signal delay occurs due to a reduction in the spacing between the metal lines. In order to reduce the signal delay, a metal line material is replaced with copper (Cu) having low resistivity, and a material for an insulating layer is replaced with a material having a lower dielectric constant.

However, when a dry etchback process, which has been used in the conventional tungsten (W) and aluminum (Al) line formation processes, is applied to copper, as the replacement line material, copper reacts with chlorine (Cl) to thus form a copper-chlorine complex having low volatility.

The copper-chlorine complex remains on the surface of the substrate and acts as an obstacle that interferes with the etching, thereby causing problems in pattern formation.

In order to overcome these problems, a chemical mechanical polishing (hereinafter abbreviated as 'CMP') process has been introduced. Specifically, copper is deposited in the etched line in an interlayer dielectric through a damascene process using the CMP process, after which the remaining copper is removed and the surface is planarized.

This planarization process generally uses a chemical mechanical polishing process for polishing and planarizing an insulating film or a metal material by pressing and rotating a silicon wafer on a polishing cloth while supplying a slurry containing a mixture of abrasive particles and a chemical. The surface of the silicon wafer may be effectively planarized through the polishing process including both chemical removal and mechanical removal.

However, the abrasive particles or chemicals used in the CMP process contaminate the surface of the wafer, and thus pattern defects, poor adhesion, and poor electrical characteristics may occur, and therefore it is necessary to completely remove contaminants. In the post-CMP cleaning process for removing contaminants, brush cleaning is typically performed using the chemical action of the cleaning solution and the physical action of the sponge brush in combination.

However, undesired substances are unintentionally deposited on the surface of the wafer by the cleaning solution after CMP, which may deteriorate the quality of the semiconductor being produced. Furthermore, the cleaning solution may come into contact with the exposed copper lines, whereby wedge corrosion may occur along the interface between the metal film, such as Ta or TaN, and the copper line, thus causing a so-called side slit phenomenon which lowers the reliability of the device.

Accordingly, research has been conducted into a cleaning composition capable of effectively removing contaminants from the wafer surface and also of preventing corrosion of the metal line material during cleaning.

For example, Korean Patent Application Publication No. 10-2015-0054471 discloses a post-CMP cleaning composition including tetraalkylammonium hydroxide, particularly tetramethylammonium hydroxide, ascorbic acid, citric acid, and deionized water, in which the cleaning composition does not contain an amine compound other than tetraalkylammonium hydroxide.

As another example, Korean Patent No. 10-1572639 discloses a post-CMP cleaning solution composition, including 0.01 to 10 wt % of 2-amino-2-methyl-1-propanol, 0.1 to 10 wt % of quaternary ammonium hydroxide (particularly tetramethylammonium hydroxide), 0.001 to 3 wt % of a chelating agent, 0.001 to 5 wt % of piperazine, and the remainder of ultrapure water such that the total weight of the composition is 100 wt %.

As still another example, Korean Patent Application Publication No. 10-2014-0139565 discloses a cleaning composition, including at least one quaternary base (particularly tetramethylammonium hydroxide), at least one amine (particularly monoethanolamine), at least one azole corrosion inhibitor (particularly 1,2,4-triazole), at least one reducing agent (particularly ascorbic acid), and water.

DISCLOSURE

Technical Problem

Accordingly, an objective of the present invention is to provide a post-CMP cleaning composition, which is capable of effectively removing impurities from the surface of a wafer substrate after CMP and also of preventing corrosion of metal line materials.

Technical Solution

In order to accomplish the above objective, a specific embodiment of the present invention provides a post-CMP cleaning composition, including 5 to 20 wt % of choline hydroxide, 1 to 10 wt % of tetrabutylammonium hydroxide (TBAH), 1 to 4 wt % of 1,2,4-triazole, 2 to 4 wt % of 2-hydroxypyridine (2-HPA), 0.01 to 5 wt % of polyoxyethylene nonylphenyl ether, 0.01 to 5 wt % of sorbitol-based polyether polyol, and the remainder of ultrapure water such that the total amount of the composition is 100 wt %.

According to an embodiment of the present invention, the composition may have a pH of 9 to 13.

In a preferred embodiment of the present invention, the pH change rate of the composition is 7 to 11.5%, as defined by Equation 1 below.

$$\text{pH change rate (\%)}=(D_0-D_{100})/D_0\times 100 \qquad \text{<Equation 1>}$$

In Equation 1, $D_0$ is the pH of an undiluted original composition and $D_{100}$ is the pH of the diluted solution of ultrapure water and the composition at a weight ratio of 100:1.

Advantageous Effects

According to the present invention, a cleaning composition is capable of effectively removing impurities from semiconductor materials after CMP and also of preventing the corrosion of metal line materials.

BEST MODE

Unless otherwise defined, all the technical and scientific terms used herein have the same meanings as those typically understood by those skilled in the art to which the present invention belongs. Generally, the nomenclature used herein is well known in the art and is typical.

As used herein, when any part "includes" any element, this does not mean that other elements are excluded, and such other elements may be further included unless otherwise specifically mentioned.

The manufacture of an electronic wafer chip includes the step of cleaning the semiconductor material with a liquid solution during or after chemical mechanical planarization (CMP).

The term "semiconductor material" refers to a microelectronic device that has not undergone the fabrication process, generally a silicon wafer having active regions formed on or in the surface of the silicon wafer. The connection to the active regions is achieved using multiple layers formed of metals, typically copper and tungsten, deposited on the silicon substrate. When copper is used as an interconnect material, copper is deposited in the etched line in an ILD (interlayer dielectric) using a damascene process, followed by removing excess copper, planarizing the surface using a CMP process, and then performing a cleaning process.

The purpose of the cleaning process (post-CMP cleaning) is to remove residue left by the CMP step from the surface of the semiconductor material, without significantly etching the metal, leaving deposits on the surface or significantly contaminating the semiconductor material.

It is also preferred to protect the metal surface from corrosion through various mechanisms such as chemical etching, galvanic corrosion or photo-induced corrosion. Corrosion of metal surfaces causes thinning of metal recesses and metal lines. Since neutral to alkaline slurries are often used for copper and barrier CMP, it is preferred to obtain an effective cleaning solution in an alkaline pH environment in which abrasive particles may be sufficiently loaded and efficiently removed. Alkaline chemicals are often used in brush scrubbers or megasonic cleaning units for post-CMP cleaning.

The post-CMP cleaning composition (which may be abbreviated as a "cleaning solution" in the description above and below) may contain various chemicals that act differently during the cleaning process.

For example, the cleaning solution should contain a "cleaning agent". The "cleaning agent" is a component of a solution that removes residual CMP slurry particles, typically metal particles, from the surface of a semiconductor material.

The cleaning solution may also contain a "chelating agent" and/or a "corrosion-inhibiting compound".

The "chelating agent" forms a complex with the metal in the cleaning solution to thereby prevent re-deposition of the removed metal on the semiconductor material. The "corrosion-inhibiting compound" is a component of the cleaning solution that protects a metal surface from attack through mechanisms such as the aggressive nature of the cleaning solution, oxidation, corrosion after cleaning, galvanic attack, or photo-induced attack.

The ability of cleaning chemicals to remove the residual metal and retain it in the cleaning solution is an important feature of the post-CMP cleaning solution. The chemical that may form a complex with the residual metal in the cleaning solution is an effective cleaning agent because the residual metal is not re-deposited on the semiconductor material after removal. The cleaning solution including a chemical that is unable to form a complex with the residual metal typically exhibits poor performance during a predetermined cleaning process. Therefore, a cleaning solution containing a chelating agent is preferable.

Also, when the cleaning solution includes a corrosion-inhibiting compound, the semiconductor material may be protected from corrosion of the metal surface. The metal surface of copper, which is a typical semiconductor material, forms the guide path of a semiconductor wafer. Since the size of the characteristic portion of the semiconductor wafer is very small, the metal line is made as thin as possible while still being able to carry a predetermined current. Any corrosion on the metal recess or surface causes thinning (dissolution) of the line and degrades or impairs the performance of the semiconductor device. An effective corrosion-inhibiting compound reduces corrosion of the metal after the cleaning step.

The corrosion-inhibiting compound acts by reducing the surface of the metal, providing a protective film on the surface of the metal, or removing oxygen.

Hence, it is preferred to provide alkaline chemicals, which prevent corrosion of the metal, prevent oxidation of the metal surface, efficiently remove the particles, remove the metal from the dielectric surface, have a pH close to the pH of the previous CMP step and do not contaminate the semiconductor surface. The chemicals of the present invention include various additives in order to provide a solution satisfying all of the above requirements.

In a specific embodiment of the present invention, the post-CMP cleaning composition includes 5 to 20 wt % of choline hydroxide, 1 to 10 wt % of tetrabutylammonium hydroxide (TBAH), 1 to 4 wt % of 1,2,4-triazole, 2 to 4 wt % of 2-hydroxypyridine (2-HPA), 0.01 to 5 wt % of polyoxyethylene nonylphenyl ether, 0.01 to 5 wt % of sorbitol-based polyether polyol, and the remainder of ultrapure water such that the total amount of the compound is 100 wt %.

Particularly, choline hydroxide and tetrabutylammonium hydroxide (TBAH) are components capable of acting as cleaning agents, and function to clean the residual metal from the dielectric surface and remove CMP slurry particles from the semiconductor material, thereby efficiently cleaning the surface of the semiconductor material. TBAH is able to sufficiently provide an alkaline cleaning solution even when added in a decreased amount compared to tetramethylammonium hydroxide (TMAH), which is a quaternary ammonium hydroxide used in various conventional post-CMP cleaning compositions, and also to reduce the pH change rate of the cleaning composition, whereby the alkaline environment during the cleaning process may be stably maintained. This is ultimately preferable because it is capable of reducing processing costs and exhibiting superior cleaning effects compared to the cleaning solution using TMAH.

The choline hydroxide and TBAH having the above functions are included in a combined amount of 6 to 30 wt % based on the total amount of the post-CMP cleaning composition. If the combined amount thereof is less than 6 wt %, the resulting post-CMP cleaning composition may not exhibit sufficient cleaning effects. On the other hand, if the combined amount thereof exceeds 30 wt %, the corrosion of the metal component may be severe, whereby metallic particles may remain on the surface of the wafer, which may cause problems attributable to the metallic particles in subsequent processes.

According to the present invention, the post-CMP cleaning composition may include 2-hydroxypyridine and 1,2,4-triazole, which function as corrosion inhibitors. These components may prevent the oxidation of copper and minimize the harm caused to the metal surface by the cleaning agent. In order to protect the metal of the semiconductor material from corrosion, a reducing-agent-film-forming agent and/or an oxygen scavenger may be used. Considering a variety of mechanisms, the post-CMP cleaning composition of the present invention may contain various kinds of components described above as the corrosion inhibitor.

Specifically, the post-CMP cleaning composition may include 3 to 8 wt % of 2-hydroxypyridine and 1,2,4-triazole.

If the combined amount of 2-hydroxypyridine (2-HPA) and 1,2,4-triazole is less than 3 wt % based on the total amount of the composition, the effect as a corrosion inhibitor is not sufficiently exhibited and the metal lines, in particular, the copper lines, formed on the semiconductor surface, may be damaged. On the other hand, if the combined amount thereof exceeds 8 wt %, the removal of contaminants from the surface of the wafer may be impeded, thereby causing the contaminants to remain.

Also, 0.01 to 5 wt % of polyoxyethylene nonylphenyl ether and 0.01 to 5 wt % of sorbitol-based polyether polyol may be included.

The post-CMP cleaning composition according to the present invention is an aqueous solution including the above cleaning agent, corrosion inhibitor and chelating agent, and also includes ultrapure water in a remaining amount, in addition to the amounts of the above components.

In an embodiment of the present invention, the composition has a pH of 9 to 13, which is alkaline suitable for the pH of actual alkaline CMP slurry. Some of the CMP processes use an alkaline slurry, and therefore, an alkaline post-CMP cleaning composition is preferably used. The use of an alkaline cleaning solution may avoid problems associated with changes in pH in the processing equipment. Furthermore, silica-based CMP slurries are often stabilized in the alkaline pH range in which the particles have a strongly negative surface charge. Cleaning with alkaline pH chemicals effectively removes particles due to the charge of the particles and the repulsive action of the particles from similarly charged surfaces.

Meanwhile, according to some processes for planarizing the wafer surface, an additional rinsing step using water or an inhibitor solution may be performed after the cleaning step.

Rinsing with water may leave a deposit on the surface of the semiconductor material, which may contaminate the wafer. Accordingly, it is preferred that the post-CMP cleaning composition be removed under the condition that the alkalinity is maintained even during the rinsing with water.

Hence, in the composition according to a preferred embodiment of the present invention, a pH change rate may fall in the range of 7 to 11.5%, as defined in Equation 1 below.

$$\text{pH change rate (\%)}=(D_0-D_{100})/D_0\times 100 \qquad \text{<Equation 1>}$$

In Equation 1, $D_0$ is the pH of the undiluted original composition and $D_{100}$ is the pH of the diluted solution of ultrapure water and the composition at a weight ratio of 100:1.

It is needless to say that, if the original pH value of the composition is maintained even upon dilution with an excessive amount of water as described above, the composition may exhibit superior cleaning capability without leaving a deposit on the surface of the semiconductor material.

The post-CMP cleaning composition according to the present invention is useful as an alkaline cleaning solution, which prevents corrosion of the metal, prevents oxidation of the metal surface, efficiently removes the particles, removes the metal from the dielectric surface, has a pH close to the pH of the previous CMP step, and does not contaminate the semiconductor surface.

MODE FOR INVENTION

Examples 1 to 48: Preparation of Post-CMP Cleaning Solution Composition

Respective post-CMP cleaning compositions were prepared by mixing the components in the amounts shown in Table 1 below. In Table 1, the numeric values are represented in the unit of wt %.

Here, X-100 is polyoxyethylene nonylphenyl ether, and SE-1 is sorbitol-based polyether polyol.

TABLE 1

| | Choline hydroxide | | | | TBAH | | | 1,2,4-triazole | | 2-HPA | | X-100 | SE-1 |
|---|---|---|---|---|---|---|---|---|---|---|---|---|---|
| | 5% | 10% | 15%F | 20% | 1% | 5% | 10% | 1% | 4% | 2% | 4% | 2.5% | 2.5% |
| Example 1 | ○ | | | | ○ | | | ○ | | ○ | | ○ | ○ |
| Example 2 | ○ | | | | ○ | | | ○ | | | ○ | ○ | ○ |
| Example 3 | ○ | | | | ○ | | | | ○ | ○ | | ○ | ○ |
| Example 4 | ○ | | | | ○ | | | | ○ | | ○ | ○ | ○ |
| Example 5 | ○ | | | | | ○ | | ○ | | ○ | | ○ | ○ |
| Example 6 | ○ | | | | | ○ | | ○ | | | ○ | ○ | ○ |
| Example 7 | ○ | | | | | ○ | | | ○ | ○ | | ○ | ○ |
| Example 8 | ○ | | | | | ○ | | | ○ | | ○ | ○ | ○ |
| Example 9 | ○ | | | | | | ○ | ○ | | ○ | | ○ | ○ |
| Example 10 | ○ | | | | | | ○ | ○ | | | ○ | ○ | ○ |
| Example 11 | ○ | | | | | | ○ | | ○ | ○ | | ○ | ○ |
| Example 12 | ○ | | | | | | ○ | | ○ | | ○ | ○ | ○ |
| Example 13 | | ○ | | | ○ | | | ○ | | ○ | | ○ | ○ |
| Example 14 | | ○ | | | ○ | | | ○ | | | ○ | ○ | ○ |
| Example 15 | | ○ | | | ○ | | | | ○ | ○ | | ○ | ○ |
| Example 16 | | ○ | | | ○ | | | | ○ | | ○ | ○ | ○ |
| Example 17 | | ○ | | | | ○ | | ○ | | ○ | | ○ | ○ |
| Example 18 | | ○ | | | | ○ | | ○ | | | ○ | ○ | ○ |
| Example 19 | | ○ | | | | ○ | | | ○ | ○ | | ○ | ○ |
| Example 20 | | ○ | | | | ○ | | | ○ | | ○ | ○ | ○ |

TABLE 1-continued

| | Choline hydroxide | | | | TBAH | | | 1,2,4-triazole | | 2-HPA | | X-100 | SE-1 |
|---|---|---|---|---|---|---|---|---|---|---|---|---|---|
| | 5% | 10% | 15%F | 20% | 1% | 5% | 10% | 1% | 4% | 2% | 4% | 2.5% | 2.5% |
| Example 21 | | ○ | | | | | ○ | ○ | | ○ | | ○ | ○ |
| Example 22 | | ○ | | | | | ○ | ○ | | | ○ | ○ | ○ |
| Example 23 | | ○ | | | | | ○ | | ○ | ○ | | ○ | ○ |
| Example 24 | | ○ | | | | | ○ | | ○ | | ○ | ○ | ○ |
| Example 25 | | | ○ | | ○ | | | ○ | | ○ | | ○ | ○ |
| Example 26 | | | ○ | | ○ | | | ○ | | | ○ | ○ | ○ |
| Example 27 | | | ○ | | ○ | | | | ○ | ○ | | ○ | ○ |
| Example 28 | | | ○ | | ○ | | | | ○ | | ○ | ○ | ○ |
| Example 29 | | | ○ | | | ○ | | ○ | | ○ | | ○ | ○ |
| Example 30 | | | ○ | | | ○ | | ○ | | | ○ | ○ | ○ |
| Example 31 | | | ○ | | | ○ | | | ○ | ○ | | ○ | ○ |
| Example 32 | | | ○ | | | ○ | | | ○ | | ○ | ○ | ○ |
| Example 33 | | | ○ | | | | ○ | ○ | | ○ | | ○ | ○ |
| Example 34 | | | ○ | | | | ○ | ○ | | | ○ | ○ | ○ |
| Example 35 | | | ○ | | | | ○ | | ○ | ○ | | ○ | ○ |
| Example 36 | | | ○ | | | | ○ | | ○ | | ○ | ○ | ○ |
| Example 37 | | | | ○ | ○ | | | ○ | | ○ | | ○ | ○ |
| Example 38 | | | | ○ | ○ | | | ○ | | | ○ | ○ | ○ |
| Example 39 | | | | ○ | ○ | | | | ○ | ○ | | ○ | ○ |
| Example 40 | | | | ○ | ○ | | | | ○ | | ○ | ○ | ○ |
| Example 41 | | | | ○ | | ○ | | ○ | | ○ | | ○ | ○ |
| Example 42 | | | | ○ | | ○ | | ○ | | | ○ | ○ | ○ |
| Example 43 | | | | ○ | | ○ | | | ○ | ○ | | ○ | ○ |
| Example 44 | | | | ○ | | ○ | | | ○ | | ○ | ○ | ○ |
| Example 45 | | | | ○ | | | ○ | ○ | | ○ | | ○ | ○ |
| Example 46 | | | | ○ | | | ○ | ○ | | | ○ | ○ | ○ |
| Example 47 | | | | ○ | | | ○ | | ○ | ○ | | ○ | ○ |
| Example 48 | | | | ○ | | | ○ | | ○ | | ○ | ○ | ○ |
| Comparative Example 1 | | | | | | | | | ○ | | ○ | ○ | ○ |
| Comparative Example 2 | | | | | | | ○ | | ○ | | ○ | ○ | ○ |
| Comparative Example 3 | | | | ○ | | | | | ○ | | ○ | ○ | ○ |
| Comparative Example 4 | | | | ○ | | | ○ | | | | ○ | ○ | ○ |
| Comparative Example 5 | | | | ○ | | | ○ | | | | | ○ | ○ |

Test 1

Evaluation of Slurry Removal Capability

Examples 1 to 4 were evaluated for slurry removal capability. The evaluation method was as follows.

(1) A Cu wafer (thickness: 6,500 Å) was immersed in a Cu barrier slurry for 1 min.

(2) The wafer contaminated with the Cu barrier slurry was dried at room temperature for 5 min.

(3) Whether the surface of the wafer was contaminated was observed through FE-SEM.

(4) The wafer was cleaned with the cleaning solution of each of Examples 1 to 4 (100:1 diluted solution) for 1 min and then washed with DIW for 1 min.

(5) The surface of the wafer was observed through FE-SEM, and the slurry removal capability was evaluated on a ten-point scale: 10=highest, 9=very high, 8=extremely good, 7=good, 6=slightly good, 5=fair, 4=slightly low, 3=low, 2=very low, 1=bad, 0=extremely bad.

The composition including a mixture of choline hydroxide and tetrabutylammonium hydroxide exhibits the greatest slurry removal capability.

Test 2

Evaluation of Cu Surface Roughness

Examples were evaluated for surface roughness. The evaluation method was as follows.

(1) A Cu wafer (thickness: 6,500 Å) was immersed in the cleaning solution of each of Examples 5 to 9 (100:1 diluted solution) for 10 min.

(2) The wafer was dried at room temperature for 5 min.

(3) The average roughness of the wafer surface was measured through AFM and the average roughness was evaluated on a ten-point scale: 10=highest, 9=very high, 8=extremely good, 7=good, 6=slightly good, 5=fair, 4=slightly low, 3=low, 2=very low, 1=bad, 0=extremely bad.

The composition including a mixture of 1,2,4-triazole and 2-hydroxypyridine exhibits vastly superior Cu roughness (Ra).

Test 3

Evaluation of Cu Corrosion Rate

Examples were evaluated for corrosion rate of a Cu wafer surface.

The evaluation method was described below.

(1) The measurement instrument was an impedance meter, and the measurement results were as follows.

(2) The cleaning solution was a diluted solution of DI: undiluted solution at a ratio of 100:1.

(3) The corrosion rate was evaluated on a ten-point scale: 10=highest, 9=very high, 8=extremely good, 7=good, 6=slightly good, 5=fair, 4=slightly low, 3=low, 2=very low, 1=bad, 0=extremely bad.

The composition including a mixture of 1,2,4-triazole and 2-hydroxypyridine exhibits the lowest Cu corrosion rate (mm/year).

Test 4

Evaluation of Contact Angle (Evaluation of BTA Removal Capability)

Examples were evaluated for the contact angle. The evaluation method was as follows.

(1) A Cu wafer (thickness: 6,500 Å) was immersed in a 0.5 wt % benzotriazole (BTA) solution (pH=2) for 1 min.

(2) The wafer was dried using deionized water (DIW) and nitrogen ($N_2$).

(3) The wafer was immersed in the cleaning solution of each of Examples 15 to 20 (100:1 diluted solution) for 5 min.

(4) The Cu-deposited wafer was evaluated for DIW contact angle before and after treatment with the BTA solution. The case where the contact angle was close to the initial value was judged to be the highest, that is, 10, and other scores of 9=very high, 8=extremely good, 7=good, 6=slightly good, 5=fair, 4=slightly low, 3=low, 2=very low, 1=bad, 0=extremely bad were given.

The evaluation results of Tests 1 to 4 are shown in Table 2 below.

TABLE 2

| | Slurry removal capability | Roughness | Corrosion rate | Contact angle | Overall evaluation |
|---|---|---|---|---|---|
| Example 1 | 5 | 5 | 7 | 6 | 23 |
| Example 2 | 5 | 5 | 6 | 5 | 21 |
| Example 3 | 5 | 6 | 6 | 5 | 22 |
| Example 4 | 5 | 6 | 5 | 6 | 22 |
| Example 5 | 7 | 6 | 8 | 6 | 27 |
| Example 6 | 7 | 6 | 7 | 6 | 26 |
| Example 7 | 6 | 5 | 7 | 6 | 24 |
| Example 8 | 6 | 6 | 6 | 6 | 24 |
| Example 9 | 5 | 6 | 7 | 6 | 24 |
| Example 10 | 5 | 7 | 6 | 5 | 23 |
| Example 11 | 5 | 6 | 6 | 5 | 22 |
| Example 12 | 5 | 6 | 5 | 6 | 22 |
| Example 13 | 8 | 8 | 8 | 9 | 33 |
| Example 14 | 8 | 8 | 7 | 9 | 32 |
| Example 15 | 7 | 8 | 7 | 9 | 31 |
| Example 16 | 7 | 10 | 5 | 8 | 30 |
| Example 17 | 10 | 10 | 10 | 10 | 40 |
| Example 18 | 9 | 9 | 9 | 8 | 35 |
| Example 19 | 8 | 9 | 9 | 9 | 35 |
| Example 20 | 8 | 9 | 8 | 8 | 33 |
| Example 21 | 7 | 6 | 8 | 6 | 27 |
| Example 22 | 7 | 5 | 7 | 6 | 25 |
| Example 23 | 6 | 6 | 7 | 8 | 27 |
| Example 24 | 6 | 7 | 6 | 7 | 26 |
| Example 25 | 7 | 7 | 8 | 5 | 27 |
| Example 26 | 6 | 7 | 8 | 6 | 27 |
| Example 27 | 7 | 6 | 6 | 6 | 25 |
| Example 28 | 6 | 7 | 5 | 5 | 23 |
| Example 29 | 8 | 8 | 8 | 8 | 32 |
| Example 30 | 8 | 8 | 8 | 7 | 31 |
| Example 31 | 8 | 8 | 7 | 8 | 31 |
| Example 32 | 8 | 8 | 7 | 7 | 30 |
| Example 33 | 6 | 6 | 7 | 8 | 27 |
| Example 34 | 6 | 7 | 7 | 7 | 27 |
| Example 35 | 6 | 7 | 6 | 8 | 27 |
| Example 36 | 6 | 7 | 6 | 7 | 26 |
| Example 37 | 5 | 6 | 7 | 6 | 24 |
| Example 38 | 5 | 6 | 6 | 5 | 22 |
| Example 39 | 5 | 6 | 7 | 5 | 23 |
| Example 40 | 5 | 5 | 6 | 5 | 21 |
| Example 41 | 5 | 5 | 7 | 5 | 22 |
| Example 42 | 5 | 6 | 6 | 5 | 22 |
| Example 43 | 5 | 5 | 6 | 6 | 22 |
| Example 44 | 5 | 5 | 5 | 5 | 20 |
| Example 45 | 5 | 5 | 6 | 5 | 21 |
| Example 46 | 5 | 6 | 5 | 5 | 21 |
| Example 47 | 5 | 5 | 6 | 7 | 23 |
| Example 48 | 5 | 5 | 5 | 5 | 20 |
| Comparative Example 1 | 1 | 1 | 3 | 2 | 7 |

TABLE 2-continued

| | Slurry removal capability | Roughness | Corrosion rate | Contact angle | Overall evaluation |
|---|---|---|---|---|---|
| Comparative Example 2 | 2 | 3 | 3 | 2 | 10 |
| Comparative Example 3 | 3 | 3 | 4 | 2 | 12 |
| Comparative Example 4 | 4 | 3 | 2 | 2 | 11 |
| Comparative Example 5 | 4 | 2 | 1 | 1 | 10 |

As is apparent from the above results, it can be confirmed that the composition, including 5 to 20 wt % of choline hydroxide, 1 to 10 wt % of tetrabutylammonium hydroxide (TBAH), 1 to 4 wt % of 1,2,4-triazole, 2 to 4 wt % of 2-hydroxypyridine (2-HPA), 0.01 to 5 wt % of polyoxyethylene nonylphenyl ether, 0.01 to 5 wt % of sorbitol-based polyether polyol and the remainder of ultrapure water such that the total amount of the composition is 100 wt %, is useful as a post-CMP cleaning composition, which is substantially alkaline, and can be maintained without a great change even in a weakly alkaline environment and is thus ultimately capable of effectively removing impurities from the surface of the wafer substrate after CMP and also of preventing corrosion of the metal line material.

Preferably, the post-CMP cleaning composition includes 10 to 15 wt % of choline hydroxide and 1 to 5 wt % of tetrabutylammonium hydroxide (TBAH).

Most preferably, the post-CMP cleaning composition includes 10 wt % of choline hydroxide and 5 wt % of tetrabutylammonium hydroxide (TBAH).

All simple modifications or variations of the present invention may be readily made by those skilled in the art, and all such modifications and variations are considered to be included within the scope of present invention.

The invention claimed is:

1. A post-chemical-mechanical-polishing cleaning composition, comprising choline hydroxide, tetrabutylammonium hydroxide, 1,2,4-triazole, 2-hydroxypyridine, polyoxyethylene nonylphenyl ether, and sorbitol-based polyether polyol, wherein the post-chemical-mechanical-polishing cleaning composition comprises 5 to 20 wt % of choline hydroxide, 1 to 10 wt % of tetrabutylammonium hydroxide, 1 to 4 wt % of 1,2,4-triazole, 2 to 4 wt % of 2-hydroxypyridine, 0.01 to 5 wt % of polyoxyethylene nonylphenyl ether, 0.01 to 5 wt % of sorbitol-based polyether polyol, and a remainder of ultrapure water such that a total amount of the composition is 100 wt %.

2. The post-chemical-mechanical-polishing cleaning composition of claim 1, comprising 10 to 15 wt % of choline hydroxide and 1 to 5 wt % of tetrabutylammonium hydroxide.

3. The post-chemical-mechanical-polishing cleaning composition of claim 2, which has a pH of 9 to 13.

* * * * *